US009248069B2

(12) United States Patent
Cox et al.

(10) Patent No.: US 9,248,069 B2
(45) Date of Patent: Feb. 2, 2016

(54) CASKET LID WITH MOLDINGS

(71) Applicant: Vandor Corporation, Richmond, IN (US)

(72) Inventors: Gary L. Cox, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 14/530,293

(22) Filed: Oct. 31, 2014

(65) Prior Publication Data

US 2015/0121670 A1 May 7, 2015

Related U.S. Application Data

(60) Provisional application No. 61/898,179, filed on Oct. 31, 2013.

(51) Int. Cl.
*A61G 17/02* (2006.01)
*A61G 17/04* (2006.01)

(52) U.S. Cl.
CPC ..... *A61G 17/02* (2013.01); *A61G 17/04* (2013.01)

(58) Field of Classification Search
CPC ..... A61G 2017/0004; A61G 17/007; A61G 17/0073; A61G 17/02; A61G 17/04; B65D 5/4279; B65D 5/445; B65D 5/446; B65D 5/6697; B65D 9/32; B65D 9/34; B65D 43/163
USPC ..... 27/2–4, 14–17; 217/56, 57, 65; 229/125.01, 198.2, 199, 199.1
See application file for complete search history.

(56) References Cited

U.S. PATENT DOCUMENTS

| | | | | |
|---|---|---|---|---|
| 4,730,370 | A * | 3/1988 | Elder | 27/4 |
| 7,380,316 | B1 * | 6/2008 | Sauder et al. | 27/14 |
| 7,594,306 | B2 * | 9/2009 | Beaulne et al. | 27/14 |
| 2013/0167336 | A1 * | 7/2013 | Boots et al. | 27/14 |

* cited by examiner

*Primary Examiner* — William Miller
(74) *Attorney, Agent, or Firm* — Maginot, Moore & Beck LLP

(57) ABSTRACT

A casket lid assembly includes lower rails, upper rails, side panels and a top panel. Each lower rail has a lower surface configured to be received on a respective side of a casket base, and has an upper side that includes an angled notch. Each of the upper rails includes a first notch and a second notch. Each of the side panels has a first edge received within the angled notch of a respective lower rail, and an opposite second edge received within the first notch of the respective upper rail. The top panel has a first edge received within the second notch of the first upper rail and an opposite second edge received within the second notch of the second upper rail.

20 Claims, 4 Drawing Sheets

CASKET LID WITH MOLDINGS

This application claims the benefit of U.S. Provisional Patent Application Ser. No. 61/898,179, filed Oct. 31, 2013, which is incorporated herein by reference.

FIELD

This application relates to caskets, and particularly, to lid assemblies for use with caskets.

BACKGROUND

Burial or cremation containers, referred to herein collectively as caskets, often represent an expensive element of a traditional funeral. Costs associated with traditional caskets are attributable in part to the material and labor cost of forming a traditional casket of stained wood or finished metal material. Accordingly, one way to reduce casket (and hence funeral) costs includes the use of caskets made from alternative materials, such as paperboard, unfinished wood and composite materials. Such caskets are particularly suitable for cremation, and often provide one of the only viable alternatives in some circumstances.

To keep costs low, the caskets made from alternative materials must be easy to produce, requiring few materials and reduced labor. Additionally, the caskets made from alternative materials must have suitable durability to provide at least the basic functionality of traditional caskets, namely enclosing and supporting the deceased during transportation and presenting the deceased at ceremonies or gatherings.

While making caskets from alternative materials reduces the cost of the casket, it remains desirable to retain an appealing aesthetic appearance of the casket, especially if the casket is to be used in a traditional ceremony and/or viewing. Thus, there exists a need for caskets made from materials that look more like traditional caskets. Several products on the market attempt combine these attributes One feature of alternative material caskets that can affect the aesthetic appeal is the casket lid. While inexpensive paperboard caskets may use flat, shoebox style lids, such lids typically lack traditional appeal. To have the aesthetic appearance of a traditional casket lid, the casket lid made from alternative materials may include traditional features such as moldings and a domed or vaulted shape. Such a casket lid must be provided in a form which enables the lid to fit over the casket for use and provides an efficient shape to accommodate the deceased within the casket. To function as a traditional casket lid, the casket lid made from alternative materials must have sufficient structural integrity to withstand pressure applied to the top of the casket during use.

There is a need, therefore, for a casket lid formed out of alternative materials that addresses the needs for reduced cost, aesthetically pleasing presentation, and sufficient structural integrity without inherent difficulties associated with known casket lids formed out of alternative materials. It would be advantageous if this casket lid formed out of alternative materials required few materials and reduced labor. It would also be advantageous if this casket lid formed out of alternative materials looked and functioned as a traditional casket lid.

SUMMARY

The present invention addresses the above-stated needs by providing a casket lid assembly that includes angled side panels and a top panel, all coupled to teach other via a frame defined by a series of notched lower rails and upper rails. The resulting structure can be readily formed from alternative materials such as multidensity fiberboard and corrugated fiberboard.

In one embodiment, a casket lid assembly includes lower rails, upper rails, side panels and a top panel. Each lower rail has a lower surface configured to be received on a respective side of a casket base, and has an upper side that includes an angled notch. Each of the upper rails includes a first notch and a second notch. Each of the side panels has a first edge received within the angled notch of a respective lower rail, and an opposite second edge received within the first notch of the respective upper rail. The top panel has a first edge received within the second notch of the first upper rail and an opposite second edge received within the second notch of the second upper rail.

In accordance with another embodiment of the disclosure, a casket having the above-identified lid assembly is provided.

The above described features and advantages, as well as others, will become more readily apparent to those of ordinary skill in the art by reference to the following detailed description and accompanying drawings. While it would be desirable to provide a lid assembly for a casket that provides one or more of these or other advantageous features, the teachings disclosed herein extend to those embodiments which fall within the scope of the following description and drawings, regardless of whether they accomplish one or more of the above-mentioned advantages.

DETAILED DESCRIPTION

Figure 1:
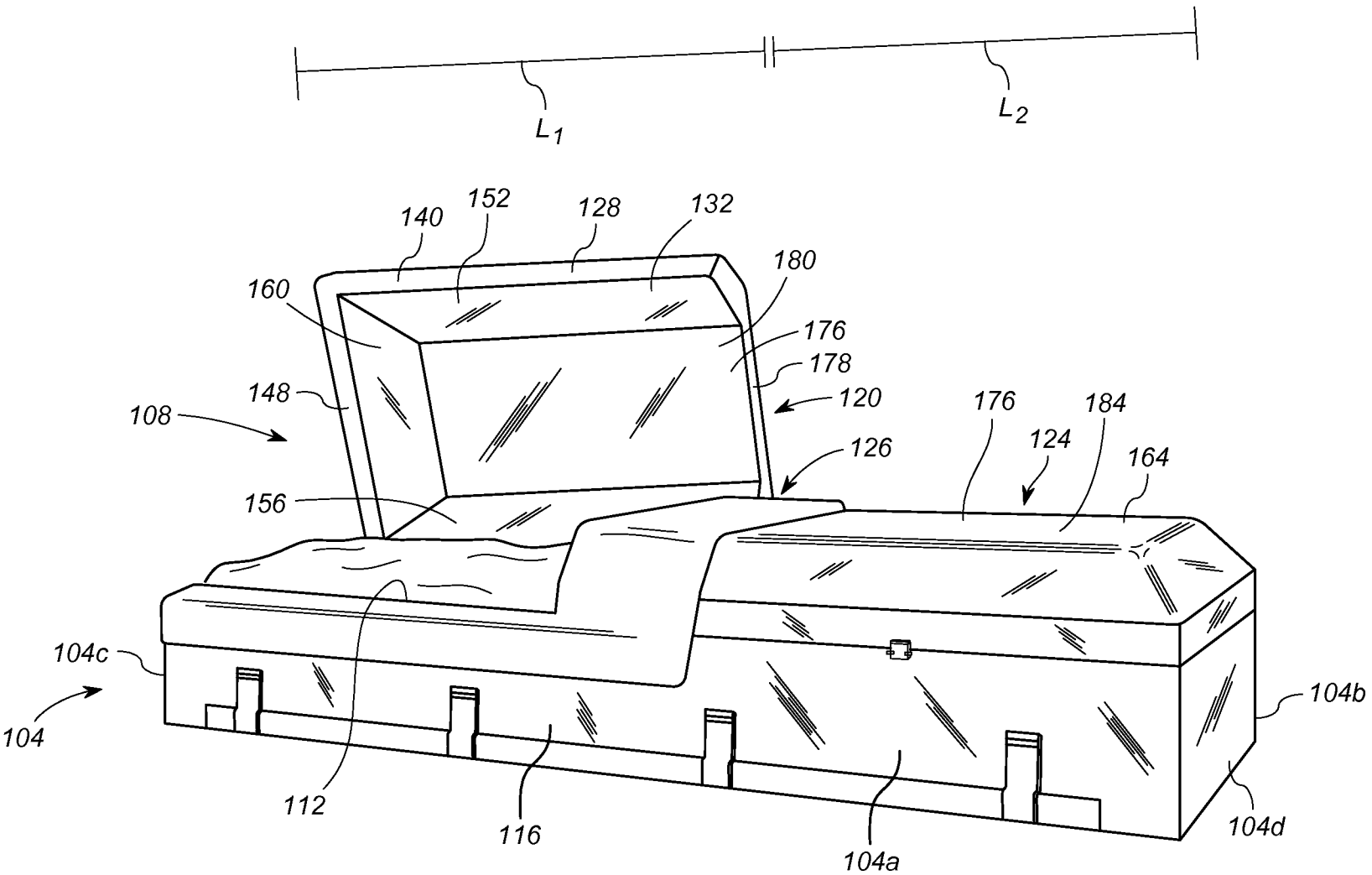
FIG. 1 depicts a top front perspective view of a casket assembly including a base portion and a lid assembly.

As shown in FIG. 1, an exemplary casket arrangement 100 includes a base portion 104 and a two-piece lid assembly 108. The base portion 104 is a container having a length and width that are sized and configured to receive a deceased. The base portion 104 is preferably formed primarily of paper-based or fiberboard materials, such as, for example, corrugated fiberboard, and is generally formed as an open topped box having an inside 112 enclosed within an outside 116. To form the box structure, the base portion 104 includes a first (front) side 104*a*, a second (rear) side 104*b*, a first end 104*c*, and a second end 104*d*.

The lid assembly 108 is preferably formed primarily of corrugated paper, particle board, and/or sheet goods material, such as lauan or plywood and is generally formed with a vaulted shape to accommodate the deceased. The lid assembly 108 is configured to fit over the base portion 104 when the deceased is contained within the base portion 104. The lid assembly 108 has the structure generally described below in connection with FIGS. 2-4.

In general reference to FIG. 1, however, the lid assembly 108 in this embodiment includes a head portion 120, configured to fit over the head and upper torso of the deceased lying within the base portion 104, and a foot portion 124 configured to fit over the lower torso, legs, and feet of the deceased lying within the base portion. The head portion 120 includes a frame 128 and a covering 132. The frame 128 forms the structural body of the head portion 120 and includes rails 140, 148 and another rail, not shown in FIG. 1, but shown as rail 144 in FIG. 2, discussed further below. The covering 132 provides the continuous interior cloth surface that is coupled to the frame 128, as will be discussed further below in detail. The foot portion 124 includes a similarly constructed frame, and a similarly constructed covering, not shown because the foot portion 124 is shown closed in FIG. 1.

The frame 128 of the head portion 120 is hingedly coupled to the base portion 104, and the frame of the foot portion is hingedly coupled to the base portion 104, such that each of the head portion 120 and the foot portion 124 is able to independently rotate about respective hinges relative to the base portion 104. Thus, as shown in FIG. 1, the head portion 120 is in the "open" position, revealing the contents of the casket arrangement 100, and the foot portion 124 is closed.

The covering 132 are preferably formed of a cloth or fabric material, such as, for example, crepe, and is positioned so as to cover the inside 112 of the casket arrangement 100 to present a smooth, aesthetically pleasing surface within the casket arrangement 100.

When the frame 128 of the head portion 120 and the frame of the foot portion 124 are both rotated downwardly to cover the base portion 104, the casket arrangement 100 is in a closed position, wherein only the outside 116 of the casket arrangement 100 is visible. The head portion 120 and the foot portion 124 are configured to align adjacent to each other at a central area 136, located near the middle of the casket arrangement 100, when the casket arrangement 100 is in the closed position such that the lid assembly 108 presents a smooth, continuous shape. When the frame 128 of the head portion 120 and the frame of the foot portion 124 are both rotated upwardly, away from the base portion 104, the casket arrangement 100 is in an opened position. When the frame 128 of the head portion 120 is rotated upwardly, away from the base portion 104, and the frame of the foot portion 124 is rotated downwardly to cover the base portion 104, the casket arrangement 100 is in a partially-opened position, as shown in FIG. 1. When the casket arrangement 100 is in the opened position or the partially-opened position, the inside 112 of the casket arrangement 100 and the deceased are at least partially visible.

The head portion 120 and the foot portion 124 are substantially identical to one another in arrangement and configuration except that, in some embodiments, a length $L_1$ of the head portion 120 is shorter than a length $L_2$ of the foot portion 124. However, in other embodiments, the length $L_1$ of the head portion 120 is substantially the same as the length $L_2$ of the foot portion 124. Because the head portion 120 and the foot portion 124 are substantially identical, the frames 128 are also substantially identical to one another.

The frame 128 includes a front lower molding rail 140, a back lower molding rail 144, an end lower molding rail 148, a front side panel 152, a back side panel 156, an end panel 160, a front upper molding rail 164, a back upper molding rail 168, an end upper molding rail 172, and a top panel 176. The covering 132 is configured to substantially cover the respective frame 128 on the inside 112 of the casket arrangement 100 to enhance the aesthetic appearance of the lid assembly 108 when the casket arrangement 100 is in the opened or partially-opened position. Further detail regarding the construction of the frame 128 and the various rails and panels thereof, is provided below in connection with FIGS. 2 and 3.

Figure 2:
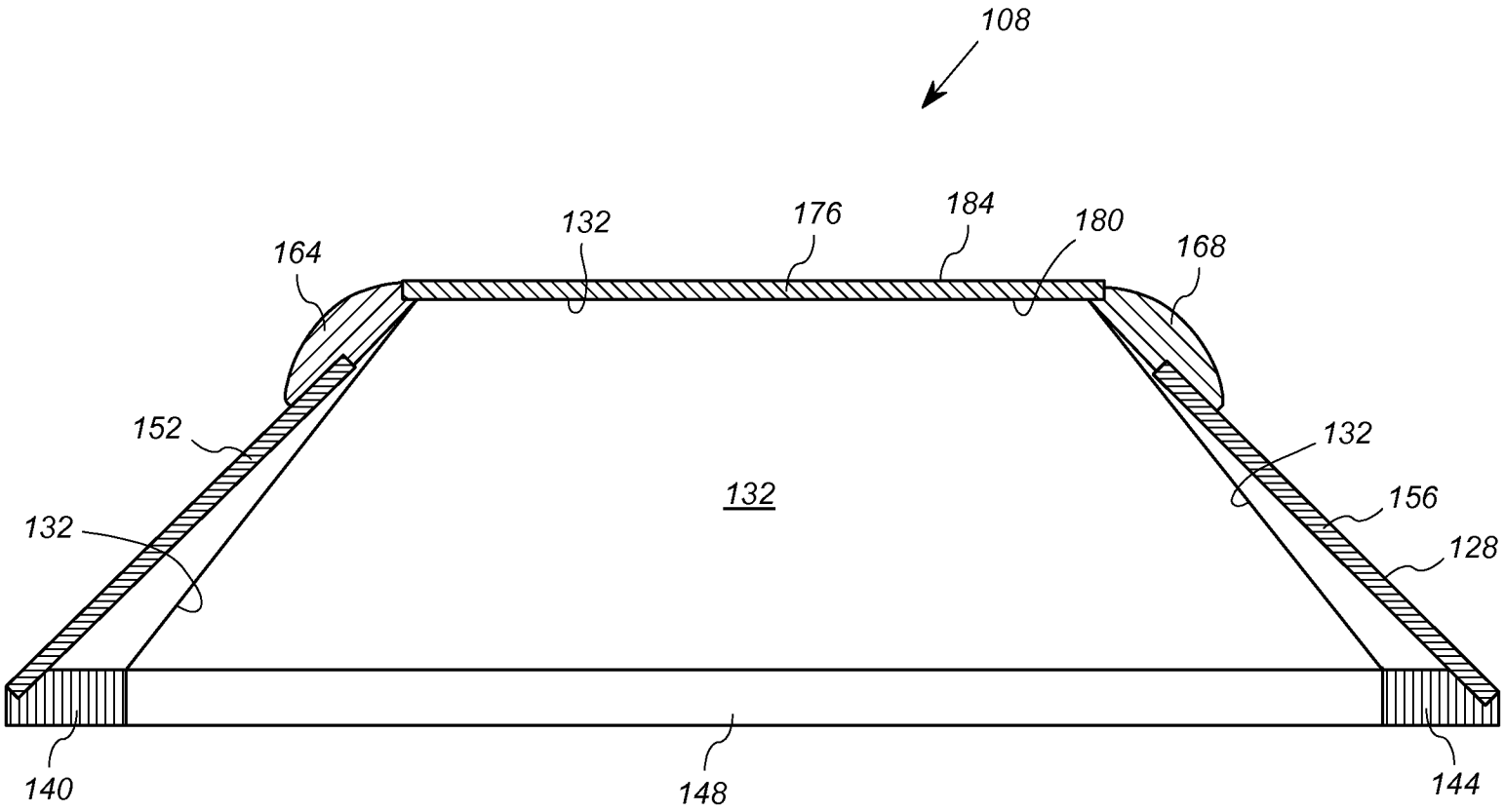
FIG. 2 depicts a cross-sectional end view of the lid assembly of FIG. 1.
Figure 3:
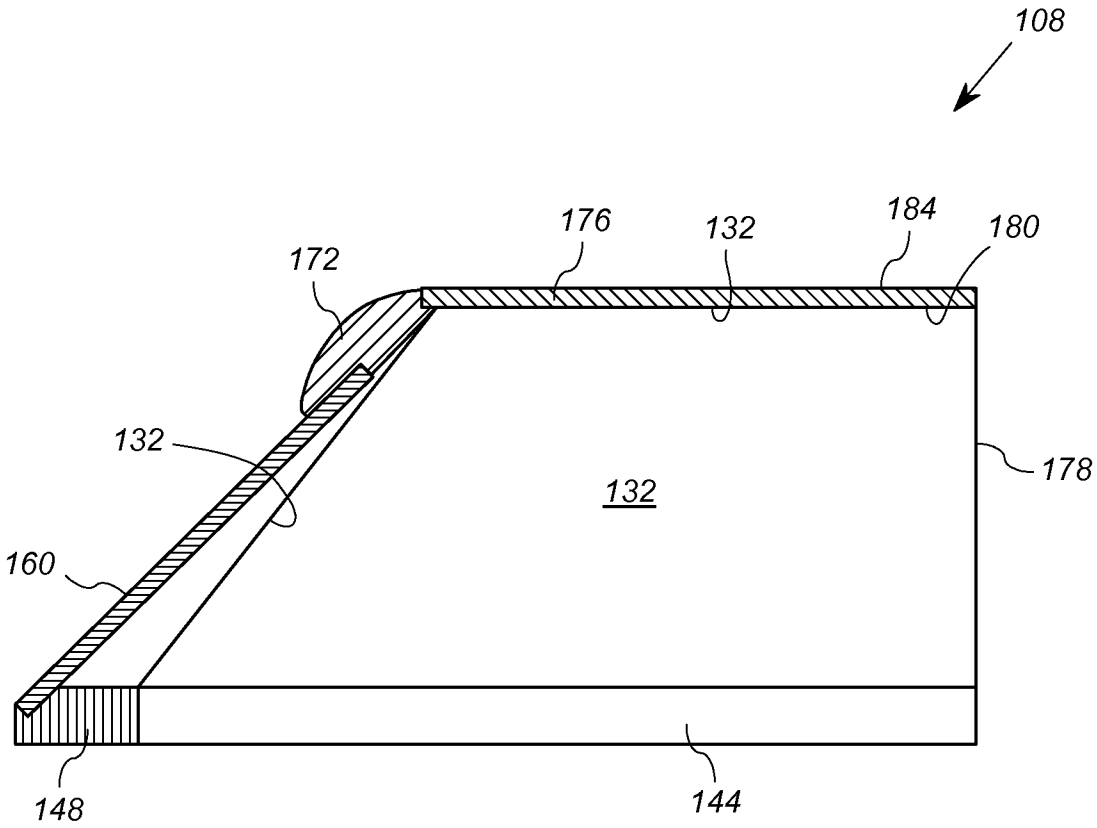
FIG. 3 depicts a cross-sectional side view of a portion of the lid assembly of FIG. 1.

More specifically, FIG. 2 depicts a cross-sectional end view and FIG. 3 depicts a cross-sectional side view of the lid assembly 108 to further illustrate the arrangement of the frame 128 and covering 132. As shown in FIG. 2, the lid assembly 108 is substantially symmetrically formed having the front lower molding rail 140 arranged opposite and substantially parallel to the back lower molding rail 144, the front panel 152 arranged opposite and mirroring the back panel 156, the front upper molding rail 164 arranged opposite and substantially parallel to the back upper molding rail 168, and the top panel 176 suspended between the front upper molding rail 164 and the back upper molding rail 168. The end panel 160 and the end upper molding rail 172 are not visible in FIG. 2 because they are obscured by the covering 132. As shown in FIG. 3, the end panel 160 and the end upper molding rail 172 are substantially identical to the front and back panels 152, 156 and the front and back upper molding rails 164, 168, respectively. The end lower molding rail 148 is positioned between the front lower molding rail 140 and the back lower molding rail 144 and is arranged perpendicularly to both of the front lower molding rail 140 and the back lower molding rail 148. Likewise, the end panel 160 is positioned between the front panel 152 and the back panel 156 and is arranged perpendicularly to both the front panel 152 and the back panel 156. The end upper molding rail 172 is also positioned between the front upper molding rail 164 and the back upper molding rail 168 and is arranged perpendicularly to both the front upper molding rail 164 and the back upper molding rail 168.

As discussed above, the lower molding rails 140, 144, 148, the panels 152, 156, 160 (shown in FIG. 3), the upper molding rails 164, 168, 172 (shown in FIG. 3), and the top panel 176 form one of the frames 128 of the lid assembly 108 having an open edge 178, an inward facing side 180 and an outward facing side 184. The open edge 178 is arranged between the front and back lower molding rails 140, 144, between the front and back panels 152, 156, and between the front and back upper molding rails 140, 144 and is thus arranged opposite the end lower molding rail 148, the end panel 160, and the end upper molding rail 172. The inward facing side 180 is formed by the sides of the lower molding rails 140, 144, 148, the panels 152, 156, 160 (shown in FIG. 3), the upper molding rails 164, 168, 172 (shown in FIG. 3), and the top panel 176 which are arranged toward one another. The outward facing side 184 is opposite the inward facing side 180 and is formed by the sides of the lower molding rails 140, 144, 148, the panels 152, 156, 160 (shown in FIG. 3), the upper molding rails 164, 168, 172 (shown in FIG. 3), and the top panel 176 that are arranged away from one another. The covering 132 is arranged on the inward facing side 180 of the lid assembly 108 and is coupled to the lid assembly 108 at least at the lower molding rails 140, 144, 148, the upper molding rails 164, 168, 172, and the top panel 176. Accordingly, when the lid assembly 108 is included in the casket assembly 100 as shown in FIG. 1, the covering 132 is arranged on the inside 112 of the casket assembly 100.

Figure 4:
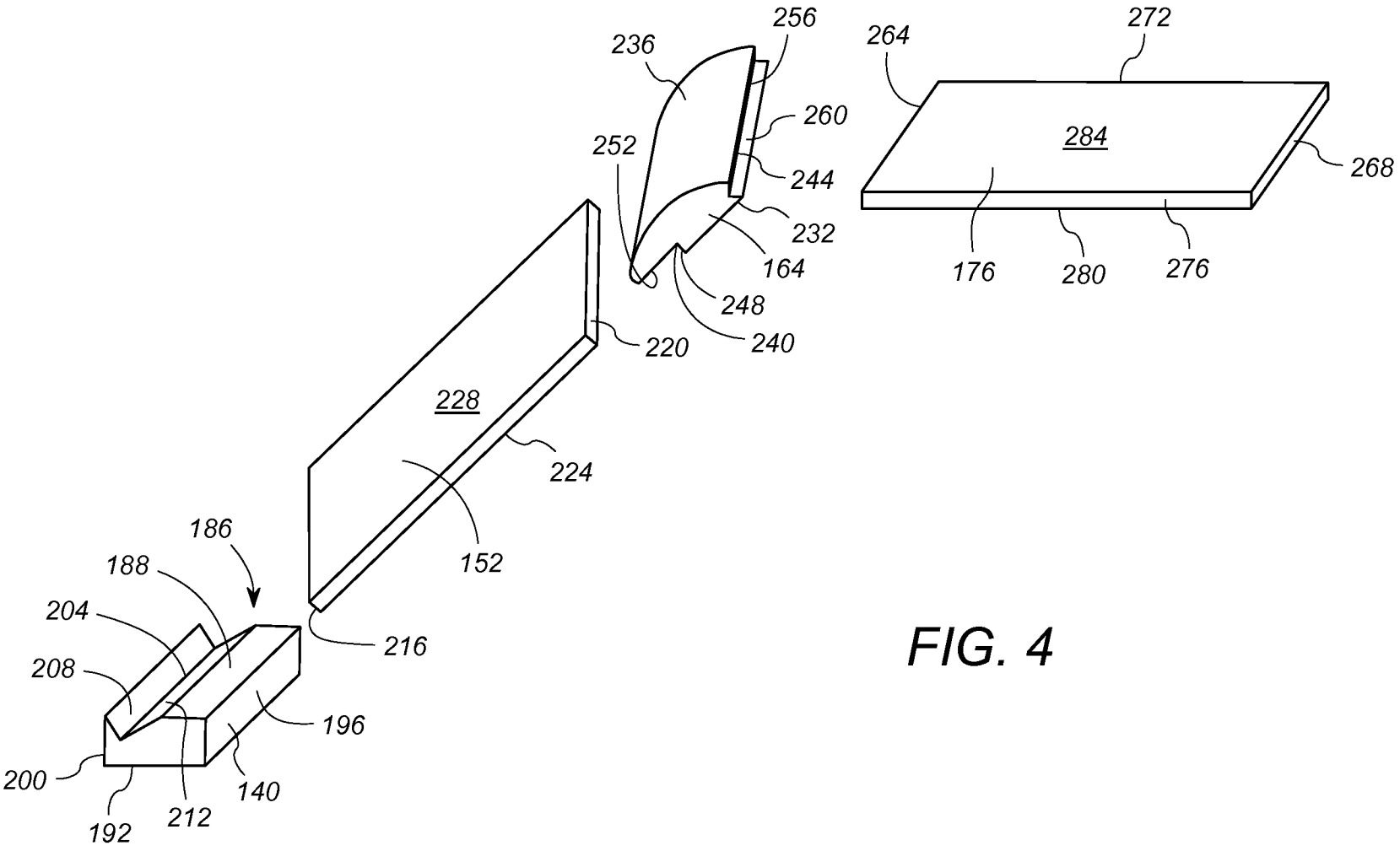
FIG. 4 depicts an exploded perspective view of a portion of the lid assembly of FIG. 1.

Turning now to FIG. 4, one lower molding rail, one panel, one upper molding rail, and a portion of the top panel 176 are shown in an exploded view. The lower molding rail shown in FIG. 4 can be any of the lower molding rails 140, 144, 148. By way of example, the lower molding rail shown in FIG. 4 is front lower molding rail 140. Likewise, the panel shown in FIG. 4 can be any of the panels 152, 156, 160. By way of example, the panel shown in FIG. 4 is the front panel 152. Similarly, the upper molding rail shown in FIG. 4 can be any of the upper molding rails 164, 168, 172. By way of example, the upper molding rail shown in FIG. 4 is the front upper molding rail 164.

Continuing with FIG. 4, the front lower molding rail 140 is preferably formed of multi-density fiberboard and is in the general form of an elongate plank that extends the length $L_1$. The lower molding rail 140 includes an upper side 186, a lower surface 192, an inward surface 196, an outward surface 200, and angled notch 204. The upper side 186 is arranged opposite to the lower surface 192, and includes the angled notch 204 and an upper surface 188 that is preferably parallel to the lower surface 192. The upper surface 188 extends from the inward surface 196 to the angled notch 204, and the outward surface 200 extends from the lower surface 192 to the angled notch 204. The inward surface 196 is arranged opposite and parallel to the outward surface 200 such that the surfaces 188, 192, 196, 200 form four sides of a rectangular prism, interrupted by the angled notch 204. The angled notch 204 is formed in the upper side 186 adjacent to the outward surface 200 and is substantially "V" shaped, including a first notch surface 208 and a second notch surface 212. Both the first notch surface 208 and the second notch surface 212 are flat surfaces and are arranged so as to come together at a right angle in the "V" shaped groove 204.

The front panel 152 is preferably formed of ¼" Lauan plywood and is a thin, planar rectangular prism including a lower edge 216, an upper edge 220, an inward surface 224, and an outward surface 228. The lower edge 216 is arranged opposite and parallel to the upper edge 220 and the inward surface 224 is arranged opposite and parallel to the outward surface 228 such that the edges 216, 220 and the surfaces 224, 228 form four faces of the rectangular prism. The front panel 152 is configured to be received within the groove 204 in the front lower molding rail 140 by bringing the lower edge 216 of the front panel 152 into contact with the first notch surface 208 of the groove 204 and bringing the inward surface 224 of the front panel 152 into contact with the second notch surface 212 of the groove 204. When the front panel 152 is received within the groove 204, the groove 204 supports the front panel 152 so as to orient the front panel 152 at a particular angle relative to the front lower molding rail 140. The angle is determined by the desired shape of the lid assembly 108. In one embodiment, the angle is preferably approximately 45 degrees. The front panel 152 is able to be attached to the front lower molding rail 140 by, for example, gluing and/or stapling the inward surface 224 of the front panel 152 to the second notch surface 212 of the groove 204 and gluing and/or stapling the lower edge 216 of the front panel 152 to the first notch surface 208 of the groove 204.

As shown in FIG. 2, because the front panel 152 is received within the groove 204 of the front lower molding rail 140, the front panel 152 is configured having a thin profile enabling the upper surface 188 of the front lower molding rail 140 to form a shelf 230. The shelf 230 is formed on the inward facing side 180 of the lid assembly 108 and extends to the inward surface 224 of the front panel 152. The shelf 230 creates a "picture frame" appearance on the inward facing side 180 of the lid assembly 108, further enhancing the aesthetic appearance of the casket arrangement 100 when the casket arrangement 100 is in the opened or partially-opened position. Additionally, because the front panel 152 has a thin profile and the shelf 230 creates a hollow space, this arrangement also reduces the weight of the lid assembly 108, which can reduce material and shipping costs.

Returning to FIG. 4, the front upper molding rail 164 includes a planar portion 232, a curved portion 236, a ledge 240, and a notch 244. The planar portion 232 and the curved portion 236 are arranged opposite one another with the planar portion 232 arranged to face inwardly and the curved portion 236 arranged to face outwardly. The ledge 240 and the notch 244 are arranged generally opposite one another and are arranged between the planar portion 232 and the curved portion 236. The ledge 240 includes an edge engaging portion 248 and a surface engaging portion 252. Both the edge engaging portion 248 and the surface engaging portion 252 are flat surfaces and are arranged so as to come together at a right angle in the ledge 240. Like the ledge 240, the notch 244 also includes an edge engaging portion 256 and a surface engaging portion 260 which are both planar and are arranged so as to come together at a right angle in the notch 244.

The ledge 240 of the front upper molding rail 164 is configured to receive the front panel 152 by contacting the upper edge 220 of the front panel 152 with the edge engaging portion 248 of the ledge 240 and contacting the outward surface 228 of the front panel 152 with the surface engaging portion 252 of the ledge 240. When the front panel 152 is received within the ledge 240, the front panel 152 is able to be attached to the front upper molding rail 164 by, for example, gluing and/or stapling the outward surface 228 of the front panel 152 to the surface engaging portion 252 of the ledge 240 and gluing and/or stapling the upper edge 220 of the front panel 152 to the edge engaging portion 248 of the ledge 240.

The top panel 176 is a rectangular prism including a front edge 264, a back edge 268, an end edge 272, an open end edge 276, an inward surface 280, and an outward surface 284. The front edge 264 and the back edge 268 are arranged opposite and parallel to one another, the end edge 272 and the open end edge 276 are arranged opposite and parallel to one another, and the inward surface 280 and the outward surface 284 are arranged opposite and parallel to one another. The top panel 176 is configured to be received in the notch 244 of the front upper molding rail 164 by contacting the front edge 264 of the top panel 176 with the edge engaging portion 256 of the notch 244 and contacting the inward surface 280 of the top panel 176 with the surface engaging portion 260 of the notch 244. When the top panel 176 is received within the notch 244, the top panel 176 can then be attached to the front upper molding rail 164 by, for example, gluing and/or stapling the front edge 264 of the top panel to the edge engaging portion 256 of the notch 244 and gluing and/or stapling the inward surface 280 of the top panel 176 to the surface engaging portion 260 of the notch.

To form each of the head portion 120 and the foot portion 124 of the lid assembly 128, the panels 152, 156, 160, the lower molding rails 140, 144, 148, the upper molding rails 164, 168, 172, and the top panel 176 are coupled together to form the frame 128. The covering 132 is then attached to the frame 128 in the manner mentioned above. More specifically, the lower molding rails 140, 144 and 148 are coupled to each other to form a bottom frame, and then the panels 152, 156, 160 and the upper molding rails 164, 166 and 172 are assembled onto the bottom frame.

In another embodiment, the head portion 120 and the foot portion 124 of the lid assembly 108 can each be formed by joining elements to form front, back, and end portions separately, bringing those portions together, joining the top panel 176 to those portions to form the frame 128, and subsequently attaching the covering 132 to the frame 128. The front portion is formed by coupling the front lower molding rail 140, the front panel 152, and the front upper molding rail 164. In particular, the lower edge 216 of the front panel 152 is coupled with the first notch surface 208 of the groove 204 of the front lower molding rail 140 and the inward surface 224 of the front panel 152 is coupled with the second notch surface 212 of the groove 204 of the front lower molding rail 140 to couple the front panel 152 to the front lower molding rail 140. The upper edge 220 of the front panel 152 is coupled to the edge engaging portion 248 of the ledge 240 of the front upper molding rail 164 and the outward surface 228 of the front panel 152 is coupled to the surface engaging portion 252 of the ledge 240 of the front upper molding rail 164 to couple the front panel 152 to the front upper molding rail 164.

Likewise, the back portion is formed by coupling the back lower molding rail 144, the back panel 156, and the back upper molding rail 168 in the same manner and the end portion is formed by coupling the end lower molding rail 148, the end panel 160, and the end upper molding rail 172 in the same manner. The front, back, and end portions are then coupled (e.g. at lower molding rails 140, 144, 148) to one another such that the front portion and the back portion are opposite and parallel to one another and the end portion is coupled to and perpendicular to both the front portion and the back portion opposite the open edge 178. The top panel 176 is then received within the notches 244 on each of the upper molding rails 164, 168, and 172. In particular, the inward surface 280 of the top panel 176 is coupled to the surface engaging portions 260 of the notches 244 of each of the upper molding rails 164, 168, 172 and the front edge 264 of the top panel 176 is coupled to the edge engaging portion 256 of the notch 244 of the front upper molding rail 164, the end edge 272 of the top panel 176 is coupled to the edge engaging portion 256 of the notch 244 of the end upper molding rail 172, and the back edge 268 of the top panel 176 is coupled to the edge engaging portion 256 of the notch 244 of the back upper molding rail 168. After the top panel 176 is attached, the covering 132 is then coupled to the frame 128 to form either the head portion 120 or the foot portion 124 of the lid assembly 108.

In an alternative embodiment, the frame 128 can be formed by joining elements to form panel, lower molding rail, and upper molding rail portions separately, bringing those portions together, joining the top panel 176 to those portions to form the frame 128, and subsequently attaching the covering 132 to the frame 128. The panel portion is formed by coupling the front panel 152, the back panel 156, and the end panel 160 to one another such that the front panel 152 and the back panel 156 are opposite and parallel to one another and the end panel 160 is coupled to and perpendicular to both the front panel 152 and the back panel 156 and opposite the open edge 178. Likewise, the lower molding rail portion is formed by coupling the front lower molding rail 140, the back lower molding rail 144 and the end lower molding rail 148 in the same manner and the upper molding rail portion is formed by coupling the front upper molding rail 164, the back upper molding rail 168, and the end upper molding rail 172 in the same manner.

The lower molding rail portion is coupled to the panel portion by coupling the lower edges 216 of the panels 152, 156, 160 with the edge engaging portions 208 of the grooves 204 of the respective lower molding rails 140, 144, 148 and by coupling the inward surfaces 224 of the panels 152, 156, 160 with the surface engaging portions 212 of the grooves 204 of the respective lower molding rails 140, 144, 148. The panel portion is coupled to the upper molding rail portion by coupling the upper edges 220 of the panels 152, 156, 160 with the edge engaging portions 248 of the ledges 240 of the respective upper molding rails 164, 168, 172 and by coupling the outward surfaces 228 of the panels 152, 156, 160 with the surface engaging portions 252 of the ledges 240 of the respective upper molding rails 164, 168, 172. The top panel 176 is then received within the notches 244 on each of the upper molding rails 164, 168, and 172 in the same manner as described with respect to the previous embodiment. After the top panel 176 is attached, the covering 132 is then coupled to the frame 128 to form either the head portion 120 or the foot portion 124 of the lid assembly 108.

In at least one embodiment, when the head portion 120 or the foot portion 124 is formed as shown in FIG. 2, the lid assembly 108 further includes an interior panel coupled to the inward facing side 180 of the lid assembly 108. The interior panel can be installed in addition to or instead of the covering 132. The interior panel provides a smooth, professional aesthetic on the inward facing side 180 of the lid assembly 108 when the casket arrangement 100 is in the opened or partially-opened position. The interior panel is a flexible panel which is biased toward a flat configuration and is preferably formed of a corrugated paper or fiberboard material. The interior panel is installed in the lid assembly 108 by flexing the interior panel so that a convex side of the interior panel is oriented toward the inward facing side 180 of the lid assembly 108. The interior panel is then fitted onto the shelves 230 of the front lower molding rail 140 and the back lower molding rail 144 and released. Upon release, the interior panel partially unflexes to return to its flat configuration which presses the interior panel onto the shelves 230 and onto the inward surfaces 224 of the front and back panels 152, 156. The interior panel is thereby easily installed via interference fit into the head portion 120 or the foot portion 124 of the casket assembly 100.

It will be appreciated that the panel and rail design described above may readily be adapted in a single casket lid design. In other words, the side panels 152, 156 and top panel 176 may extend substantially the entire length of the casket base 104. In such a design, the lid would be include two opposing end panels (and associated rail structures) having substantially the same structure as the end panel 160, lower rail 148 and upper rail 172 of FIG. 3.

It will further be appreciated that the above-described embodiments are merely illustrative, and that those of ordinary skill in the art may readily devise their own implementations and modifications that incorporate the principles of the present invention and fall within the spirit and scope thereof.

What is claimed is:

1. A casket lid assembly for use in connection with a casket base, the casket base having a width and length sized to receive a deceased, the casket lid assembly comprising:

a first lower rail having a lower surface configured to be received on a first side of the casket base, the first lower rail further having an upper side generally facing in a direction opposite the lower surface, the upper side including an angled notch defined therein;

a second lower rail having a lower surface configured to be received on a second side of the casket base, the second lower rail further having an upper side generally facing in a direction opposite the lower surface, the upper side including an angled notch;

a first upper rail, the first upper rail including a first notch and a second notch;

a second upper rail including a first notch and a second notch;

a first side panel having a first edge received within the angled notch of the first lower rail and an opposite second edge received within the first notch of the first upper rail;

a top panel having a first edge received within the second notch of the first upper rail and an opposite second edge received within the second notch of the second upper rail;

a second side panel having a first edge received within the angled notch of the second lower rail and an opposite second edge received within the first notch of the second upper rail.

2. The casket lid assembly of claim 1, wherein the upper side of the first lower rail has an upper surface that terminates at the angled notch, and wherein a width of the upper surface exceeds the width of the angled notch.

3. The casket lid assembly of claim 2, wherein the angled notch of the first lower rail includes a first notch surface abutting a first surface of the first side panel, and a second notch surface abutting the first edge of the first side panel, the first notch surface wider than the second notch surface.

4. The casket lid assembly of claim 3, wherein the first lower rail includes an outward surface extending between the upper side and the lower surface, and wherein the second notch surface terminates at the outward surface.

5. The casket lid assembly of claim 1, wherein the angled notch of the first lower rail includes a first notch surface abutting a first surface of the first side panel, and a second notch surface abutting the first edge of the first side panel, the first notch surface wider than the second notch surface.

6. The casket lid assembly of claim 5, wherein the first lower rail includes an outward surface extending between the upper side and the lower surface, and wherein the second notch surface terminates at the outward surface.

7. The casket lid assembly of claim 1, wherein each of the angled notches of the first and second lower rails, the first notches of the first and second upper rails, and the second notches of the first and second upper rails, are defined by two surfaces.

8. The casket lid assembly of claim 1, wherein the first upper rail includes an inner side and an outer side, wherein the first notch and the second notch are defined in the inner side.

9. The casket lid assembly of claim 8, wherein the outer side comprises a round surface.

10. The casket lid assembly of claim 9, wherein the round surface terminates on one side at the second notch.

11. The casket lid assembly of claim 1, further comprising:

a third lower rail configured to be disposed on an end of the casket base, the third lower rail having a first end coupled to the first lower rail and a second end coupled to the second lower rail;

a third upper rail having a first end disposed adjacent to the first upper rail and a second end disposed adjacent to the second upper rail; and an end panel disposed coupled between the third lower rail and the third upper rail.

12. A casket, comprising:

a casket base having a width and length sized to receive a deceased, the casket base having a first side, a second side, a first end, and a second end;

at least one lid assembly including, a first lower rail having a lower surface configured to be received on the first side of the casket base, the first lower rail further having an upper side generally facing in a direction opposite the lower surface, the upper side including an angled notch defined therein;

a second lower rail having a lower surface configured to be received on a second side of the casket base, the second lower rail further having an upper side generally facing in a direction opposite the lower surface, the upper side including an angled notch;

a first upper rail including a first notch and a second notch;

a second upper rail including a first notch and a second notch;

a first side panel having a first edge received within the angled notch of the first lower rail and an opposite second edge received within the first notch of the first upper rail;

a top panel having a first edge received within the second notch of the first upper rail and an opposite second edge received within the second notch of the second upper rail; and a second side panel having a first edge received within the angled notch of the second lower rail and an opposite second edge received within the first notch of the second upper rail.

13. The casket of claim 12, further comprising a second lid assembly, and wherein the lid assembly and the second lid assembly cooperate to cover the casket base in a closed position.

14. The casket of claim 12, wherein the angled notch of the first lower rail includes a first notch surface abutting a first surface of the first side panel, and a second notch surface abutting the first edge of the first side panel, the first notch surface wider than the second notch surface.

15. The casket of claim 14, wherein the first lower rail includes an outward surface extending between the upper side and the lower surface, and wherein the second notch surface terminates at the outward surface.

16. The casket of claim 12, wherein each of the angled notches of the first and second lower rails, the first notches of the first and second upper rails, and the second notches of the first and second upper rails, are defined by two surfaces.

17. The casket of claim 12, wherein the first upper rail includes an inner side and an outer side, wherein the first notch and the second notch are defined in the inner side.

18. The casket of claim 17, wherein the outer side comprises a round surface.

19. The casket of claim 18, wherein the round surface terminates on one side at the second notch.

20. The casket of claim 12, further comprising:

a third lower rail configured to be disposed on an end of the casket base, the third lower rail having a first end coupled to the first lower rail and a second end coupled to the second lower rail;

a third upper rail having a first end disposed adjacent to the first upper rail and a second end disposed adjacent to the second upper rail; and an end panel disposed coupled between the third lower rail and the third upper rail.

* * * * *